US006488195B2

(12) United States Patent
White et al.

(10) Patent No.: US 6,488,195 B2
(45) **Date of Patent: *Dec. 3, 2002**

(54) MULTI-STROKE FASTENING DEVICE

(75) Inventors: Brian M. White, Bristol, RI (US); Charles W. Hewitt, Warwick, RI (US); Robert D. Olmstead, East Greenwich, RI (US)

(73) Assignee: Stanley Fastening Systems, L.P., East Greenwich, RI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/398,456

(22) Filed: Sep. 17, 1999

(65) Prior Publication Data

US 2002/0053587 A1 May 9, 2002

Related U.S. Application Data

(60) Provisional application No. 60/120,892, filed on Feb. 19, 1999, and provisional application No. 60/101,038, filed on Sep. 18, 1998.

(51) Int. Cl.[7] ..... B25C 1/04

(52) U.S. Cl. ..... 227/130; 227/120; 227/136; 173/201

(58) Field of Search ..... 227/131, 130, 227/116, 113, 120, 136; 173/201, 117

(56) References Cited

U.S. PATENT DOCUMENTS

| | | | | |
|---|---|---|---|---|
| 1,461,460 A | | 7/1923 | Schroth et al. | |
| 1,767,485 A | | 6/1930 | Shallenberger | |
| 2,796,608 A | | 6/1957 | Johnson | |
| 2,857,596 A | * | 10/1958 | Allen et al. | 227/130 |
| 2,953,787 A | * | 9/1960 | Ollig et al. | 227/116 |
| 3,114,421 A | | 12/1963 | McCloud | |
| 3,161,242 A | | 12/1964 | Etzkorn et al. | |
| 3,203,610 A | * | 8/1965 | Farrell | 227/131 |
| 3,256,944 A | | 6/1966 | Holzapfel | |
| 3,299,967 A | | 1/1967 | Cabot | 173/116 |
| 3,305,031 A | | 2/1967 | Bez et al. | |
| 3,366,302 A | * | 1/1968 | Blicharski | 227/131 |
| 3,688,848 A | | 9/1972 | Vick et al. | |
| 3,741,317 A | | 6/1973 | Unterschweiger et al. | |
| 3,774,699 A | | 11/1973 | Schmuck | |
| 3,921,729 A | | 11/1975 | Schmuck | |
| 3,926,266 A | * | 12/1975 | Dorgnon | 173/201 |
| 3,971,116 A | * | 7/1976 | Goodsmith et al. | 227/116 |

(List continued on next page.)

FOREIGN PATENT DOCUMENTS

| | | |
|---|---|---|
| EP | 0 141 712 | 5/1985 |

*Primary Examiner*—Scott A. Smith
(74) *Attorney, Agent, or Firm*—Pillsbury Winthrop LLP

(57) ABSTRACT

A multi-stroke fastening device comprising a housing, a fastener drive track carried by the housing, a striker assembly guide track mounted within the housing, a striker assembly mounted in slidable relation within said guide track, a power drive assembly, and a feed mechanism. The striker assembly includes a driver member constructed and arranged to strike a fastener disposed in the fastener drive track. The striker assembly is constructed and arranged to be moved along the guide track through a plurality of alternating drive strokes and return strokes to effect a plurality of impacts of the driver member upon the fastener in order to drive the fastener into the workpiece. The striker assembly has a substantially constant drive stroke lengths relative to the guide track. The power drive assembly is constructed and arranged to drive the striker assembly to effect the plurality of impacts of the driver member upon the fastener, and the feed mechanism is constructed and arranged to feed successive fasteners into the drive track to be struck by the striker assembly.

19 Claims, 16 Drawing Sheets

U.S. PATENT DOCUMENTS 4,064,949 A 12/1977 Chromy
4,113,035 A 9/1978 Stiltz et al.
4,114,699 A 9/1978 Wolf
4,183,453 A 1/1980 Barrett et al.
4,222,443 A 9/1980 Chromy
4,236,588 A 12/1980 Moldan et al.
4,346,767 A 8/1982 Vaughan
4,365,962 A 12/1982 Regelsberger
4,366,869 A 1/1983 Bereiter et al.
4,431,062 A 2/1984 Wanner et al.
4,442,906 A 4/1984 Simpson
4,475,680 A 10/1984 Farian ..... 227/130
4,508,180 A 4/1985 Klueber
4,511,074 A * 4/1985 Kille et al. ..... 227/131
4,529,044 A 7/1985 Klueber et al.
4,567,951 A 2/1986 Fehrle et al.
4,582,144 A 4/1986 Mizutani
4,602,689 A 7/1986 Wanner
4,609,135 A 9/1986 Elliesen
4,610,381 A * 9/1986 Kramer et al. ..... 227/130
4,611,670 A * 9/1986 Chromy ..... 173/201
4,625,903 A * 12/1986 Becht ..... 227/131
4,669,551 A * 6/1987 Lippacher et al. ..... 173/201
4,671,443 A 6/1987 Becht ..... 227/109
4,724,992 A 2/1988 Ohmori ..... 227/146
4,732,218 A 3/1988 Neumaier et al.
4,750,567 A 6/1988 Grossmann et al.
4,807,793 A 2/1989 Ghibely
5,050,687 A 9/1991 Prokhorov et al.
5,074,453 A * 12/1991 Tachihara et al. ..... 227/113
5,346,023 A 9/1994 Takagi et al.
5,435,397 A 7/1995 Demuth
5,437,339 A 8/1995 Tanaka
5,495,973 A 3/1996 Ishizawa et al. ..... 227/8
5,775,440 A 7/1998 Shinma
5,927,585 A 7/1999 Moorman et al. ..... 227/132

* cited by examiner

MULTI-STROKE FASTENING DEVICE

This application claims the benefit of U.S. Provisional Applications Nos. 60/120,892, filed Feb. 19, 1999 and of 60/101,038, filed Sep. 18, 1998, the contents of which are hereby incorporated by reference in full.

BACKGROUND OF THE INVENTION

The present invention relates to automatic fastening devices, and in particular a fastening device that drives a fastener into a workpiece by effecting multiple blows upon the fastener.

The most typical type of nailing or fastening device is that of the "single stroke" type. In these types of devices, a striker assembly is driven to fasten a fastener into a workpiece with a single blow or impact. The disadvantage of these devices is that they require very high levels of impact energy, especially when longer fastener lengths are to be used.

There have been some attempts to provide a "multi-stroke" fastening device, which employs a striker assembly, which is driven to provide a plurality of blows or impacts upon the fastener head for progressively fastening the fastener into a workpiece. Such devices have been proposed by U.S. Pat. Nos. 4,183,453; 4,724,992; 2,796,608; 3,203,610; 1,767,485; and 4,807,793. The disadvantage with these proposed devices is that the fastener striker assembly is driven through a plurality of driving strokes, the lengths of the strokes are progressively increased as the fastener is progressively driven into the workpiece. As a result, the timing for driving the striker assembly becomes more difficult to manage. In addition, because the stroke length of the striker assembly increases during the course of each fastening cycle, the "feel" of the tool is somewhat irregular. It is an object of the invention to overcome the difficulties noted above.

In accordance with this object, the present invention provides a multi-stroke fastening device for driving fasteners into a workpiece. This multi-stroke fastening device provides a housing, a fastener drive track carried by the housing, a striker assembly guide track mounted within the housing, a striker assembly mounted in slidable relation within said guide track, a power drive assembly, and a feed mechanism. The striker assembly includes a driver member constructed and arranged to strike a fastener disposed in the fastener drive track. The striker assembly is constructed and arranged to be moved along the guide track through a plurality of alternating drive strokes and return strokes to effect a plurality of impacts of the driver member upon the fastener in order to drive the fastener into the workpiece. The striker assembly has a substantially constant drive stroke lengths relative to the guide track. The power drive assembly is constructed and arranged to drive the striker assembly to effect the plurality of impacts of the driver member upon the fastener, and the feed mechanism is constructed and arranged to feed successive fasteners into the drive track to be struck by the striker assembly.

It is also an object of the invention to provide a multi-stroke fastening device which includes a striker assembly having a drive stroke length which does not progressively increase as the fastener is progressively driven into the workpiece.

It is a further object of the invention to provide a multi-stroke fastening device in which the power drive assembly is resiliently coupled to the striker assembly to maintain a predetermined range of distance therebetween.

Prior art fastening devices that drive a fastener into a workpiece with a single blow need not be concerned with the fastener driver maintaining a coupled relation with respect to the fastener being driven. Multi-blow fastening devices, on the other hand are presented with a unique problem in that if a plurality of fastening impacts are to be imparted upon a single fastener in order to drive the fastener into the workpiece, the tool tends to bounce off the fastener head with each drive stroke. This may lead to an inefficient and rather clumsy operation of the tool.

It is a further object of the present invention to provide multi-blow fastening tool that overcomes the problem noted above. In accordance with this object, the present invention provides a multi-stroke fastening device for driving fasteners into a workpiece, comprising a housing, a striker assembly guide track mounted within the housing, and a striker assembly mounted in slidable relation with respect to the guide track. The striker assembly includes a driver member constructed and arranged to strike a fastener to be driven into a workpiece. The striker assembly is moveable along the guide track through a plurality of alternating drive strokes and return strokes to effect a plurality of impacts of the driver member upon the fastener. A power drive assembly is constructed and arranged to drive the striker assembly through the plurality of alternating drive strokes and return strokes to effect the plurality of impacts of the driver member upon the fastener. A nose assembly is carried by the housing and defines a fastener drive track along which the driver travels during the drive strokes and return strokes. Furthermore, a faster head engaging structure is constructed and arranged to engage a portion of the head of the fastener to be driven at least during the return stroke. A resilient structure is operatively coupled to the fastener head engaging structure. The resilient structure is constructed and arranged to permit limited longitudinal movement of the fastener head engaging structure relative to the striker assembly guide track, and dampens impact of engagement between the fastener head engaging structure and the head of the fastener to be driven.

It is a further object of the present invention to provide a multi-stroke fastening device that employs a fastener impacting driver assembly that is pneumatically coupled to the driving structure so that impacts of the driver assembly are very effectively damped to reduce vibrations and shock in the system. In accordance with this object, the present invention provides a multistroke fastening device for driving fasteners into a workpiece, comprising a housing. The nose assembly is carried by the housing and defines a drive track. A fastener feed mechanism includes a fastener feed pawl that moves successive fasteners into the drive track. A cylinder guide track is mounted within the housing, the cylinder guide track having a forward end and a rearward end. A driver assembly is disposed in slidably sealed relation with the cylinder guide track, the driver assembly being movable forwardly through the cylinder drive track during a fastener impacting drive stroke thereof and movable rearwardly through the cylinder guide track during a return stroke thereof. The driver assembly includes a driver member movable through the drive track during alternating drive strokes and return strokes to impart a plurality of impacts upon a fastener to be driven into the workpiece so as to drive the fastener into the workpiece. A piston is disposed in slidably sealed relation with the cylinder guide track, the piston being rearwardly spaced from the driver assembly, with an air space disposed between the piston and driver assembly. A motor is operatively connected with the piston and constructed and arranged to drive the piston forwardly and rearwardly through the cylinder guide track to effect the alternating drive strokes and return strokes. Movement of the piston forwardly through the cylinder guide track compresses air within the air space so as to force the driver assembly forwardly through the cylinder guide track to effect the fastener impacting drive stroke so that the driver member impacts the fastener to be driven.

Other objects and advantages of the present invention will become apparent from the following detailed description and appended drawings of illustrative embodiments.

DETAILED DESCRIPTION OF THE INVENTION

Figure 1:
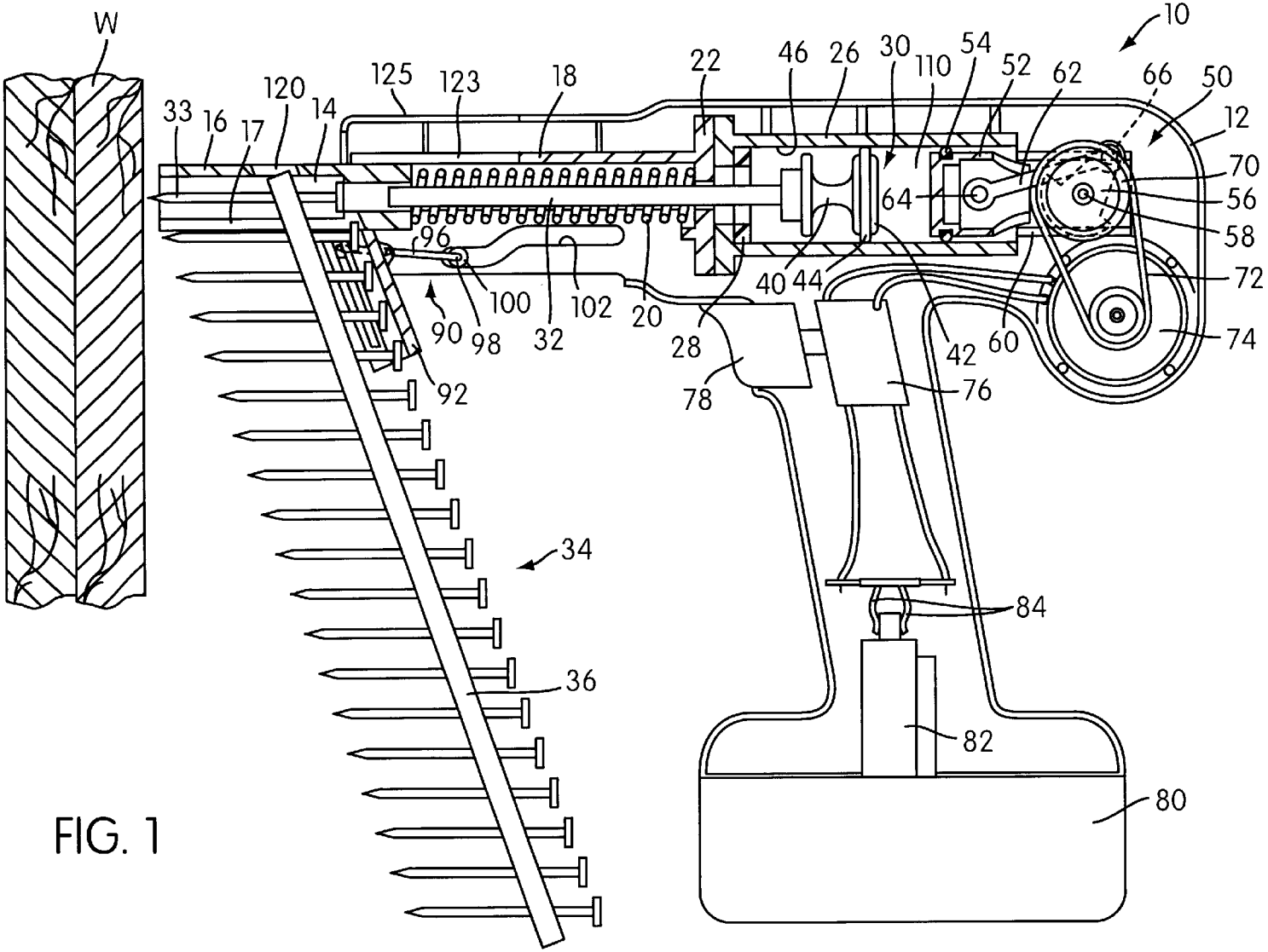
FIG. 1 is a cross-sectional view of a multi-stroke fastening device in accordance with the first embodiment of the present invention illustrating the fastening device at the start of its drive stroke.

FIG. 1 is a cross-sectional view of a multi-stroke fastening device in accordance with the first embodiment of the present invention. FIG. 1 shows the device at rest, with a first fastener in the drive track.

The fastening device 10 has an outer clam-shell housing 12, preferably made from a rigid plastic material. A fastener drive track 14 is carried by the housing 12. In the particular embodiment shown, the drive track 14 is provided by a movable nose assembly 16, which has a lower longitudinal slot 17 for receiving fasteners to be positioned in the drive track 14. The nose assembly 16 is movable axially into the housing 12 in a direction along the fastener driving axis. More particularly, a nose receiving channel 18 is fixed within the housing 12 towards the forward end of the housing 12. The nose receiving channel 18 is preferably provided with a grooved track that receives projecting flanges integrally formed on opposite sides of the nose assembly 16 so that the channel 18 slidably receives the nose assembly 16, the nose assembly being biased outwardly of the nose receiving channel 18 by a coil spring 20. The coil spring 20 has a rearward end bearing against a mounting plate 22 fixed within the housing 12 and a forward end bearing against the rearward end of the nose assembly 16, thus biasing the nose assembly 16 forwardly towards a forward stop position thereof.

A striker assembly guide track 26 is fixed within the housing 12. In the preferred embodiment shown, the guide track is a cylindrical, metal tubular member, conventionally termed a "cylinder". It is contemplated, however, that for other arrangements in accordance with the principles of the present invention, the guide track can be any structure which slidingly guides a striker assembly for impact and return strokes. The guide track 26 has an annular resilient bumper 28, preferably made from an elastomeric material such as rubber, disposed towards the forward end of the guide track 26.

A striker assembly 30 is mounted in slidable relation within the guide track 26. The striker assembly 30 includes a driver member 32 which is constructed and arranged to strike a fastener 33, which is the leading fastener within a group of collated fasteners 34. The collated fasteners 34 comprise a plurality of fasteners fixed to one another by a substantially rigid collation 36. As shown, the leading fastener 33 is disposed within the drive track 14.

The striker assembly 30 is movable axially along the guide track 26 through a plurality of alternating drive strokes and return strokes to effect a plurality of impacts of the driver member 32 upon the fastener 33 for driving the fastener 33 into a workpiece W. The driver member 32 extends through an opening within the mounting plate 22 and further extends through the center of coil spring 20 and is received at its forward end within an opening in the rearward end of the nose assembly 16 to be received in the drive track 14 for impacting upon the fasteners. The opening in mounting plate 22 and/or opening in the rearward end of nose assembly 16 maintains the driver member in axially aligned relation with the drive track 14 and hence, lead fastener 33.

The striker assembly 30 further comprises a plunger 40 to which the driver is connected. The plunger 40 has a substantially disc-shaped rearward end portion 42 having a peripheral annular groove for receiving a generally annular sealing member 44 disposed in slidable and sealed relation with an interior cylindrical surface 46 of the guide track 26.

As will be described in greater detail later, the striker assembly 30 has a substantially constant drive stroke length relative to its guide track 26. While the drive stroke may vary slightly, for example, as a result of slightly different resistances to the fastener being driven into a particular workpiece at progressive depths of the fastener, it should be appreciated that the drive stroke length does not progressively increase as the fastener 33 is progressively driven into the workpiece W, as is the case with prior art constructions.

A power drive assembly 50 is constructed and arranged to drive the striker assembly 30 to effect a plurality of impacts of the driver member 32 upon fastener 33. Preferably, the power drive assembly includes a piston 52, preferably having a generally cylindrical outer configuration, and an outer periphery having a sealing member 54 disposed in slidable and sealed relation with the inner surface 46 of the guide track 26, in similar fashion to sealing member 44. The power drive assembly 50 further includes a crank member 56 rotatable about an axis 58. More specifically, the crank member 56 is mounted to a crank mounting assembly 60, which is fixed to the guide track 26. An axis pin 58 is attached to the mounting 60 and mounts the crank 56 for rotational movement. A crank arm 62 is pivotally connected at opposite ends thereof, including a first end 64 pivotally connected to the piston 52, and opposite end 66 pivotally connected with the crank 56. Thus, rotation of the crank 56 causes reciprocating motion of the piston 52 within the guide track 26.

The crank 56 includes a pulley 70 disposed on the periphery thereof and is constructed and arranged to receive a drive belt 72. The drive belt is driven by a motor 74, which rotatably drives the crank 56 via the belt 72. Rather than a pulley and belt arrangement, a gear train or other coupling arrangement could be employed.

The motor 74 is switched on and off by a control circuit 76, which includes a trigger switch, which is activated by a manually actuated trigger 78, and preferably also includes a nose switch, which is activated by a contact trip that is engaged when the nose assembly is retracted into the tool housing. The control circuit 76 is connected with a power supply assembly, preferably including a power source in the form of a battery 80, and most preferably, a rechargeable battery. The battery 80 has a battery contact 82, which can be removed from housing contacts 84 to enable the battery 80 to be recharged and/or replaced. It should be appreciated that other power sources may be used for powering the power drive assembly 50. For example, the device may be connected with line voltage, an air pressure supply where the device is pneumatically driven, combustion power, etc.

A feed mechanism 90 is constructed and arranged to feed successive fasteners within the supply of collated fasteners 34 into the drive track 14 to enable the successive fasteners to be struck by the striker assembly 30. More particularly, the feed mechanism 90 is cooperable with a feed track 92, which, in the preferred embodiment, is integrally cast with the nose assembly 16. The feed track 92 feeds the collated fasteners 34 into the drive track 14 through the longitudinal slot 17 in the nose assembly 16. The feed mechanism 90 includes a movable feed pawl 96. The feed pawl 96 is pivotable about its rearward end portion 98, which is provided with a torsion spring 100 constructed and arranged to biased feed pawl 96 in a clockwise direction (as viewed in FIG. 1) about the rearward end portion 98. The rearward end 98 of the feed pawl 96 rides along a ramped surface 102 as the nose assembly 16 moves relative to the housing 12. The feed pawl 96 further has a more forward portion thereof pivotably connected to the feed track 92 to establish somewhat of a connecting rod type motion for the feed pawl 96 as the nose assembly 16 is moved relative to the housing 12 and the rearward end portion 98 of the feed pawl 96 rides along the ramp surface 102. As a result of this connecting rod type motion, the forward end portion of the feed pawl 96 is able to feed individual fasteners into the drive track 14 as will be appreciated from the more detailed description of the operation of the device 10 to follow.

In FIG. 1, the device 10 is shown at rest prior to a fastening operation. The collated fasteners 34 are manually manipulated up through the feed track 92, so that the first two fasteners are moved beyond the feed pawl 96, which can be manually moved out of the feed track 92 for initial loading purposes. As shown, the first fastener 33 is positioned in the drive track 14. Preferably, with the tool at rest, the forward tip of the first fastener 33 projects slightly forwardly of the fully extended forward end of the nose assembly 16, as shown. This preferred arrangement enables the user to view the tip of the fastener 33 and position the tip at a very precise location. To view the leading fastener 33 even more clearly, it is possible to manually move the nose assembly inwardly into the housing 12 against the bias of coil spring 20 to reveal a greater portion of the fastener 33 for positioning the tip at a precise location.

After the tip of fastener 33 is placed against the workpiece W, the operator depresses trigger 78, thereby closing the trigger switch in circuit 76 to provide power from the battery 80 to the motor 74. The motor 74 drives the belt 72, which in turn causes rotation of the crank 56. Rotation of the crank 56 causes reciprocal movement of the piston 52 through the connection of the piston 52 with the crank 56 via connecting arm 62. Reciprocal movement of the piston 52 within the guide track 26 causes corresponding reciprocal movement of the striker assembly 30.

More particularly, the power drive assembly 50 is resiliently coupled to the striker assembly 30 via a substantially sealed airspace 110 between the piston 52 and the rearward end portion 42 of plunger 40. More specifically, driving piston 52 forwardly towards the plunger 40 tends to reduce the distance between the piston 52 and the plunger 40. Because airspace 110 between piston 52 and plunger 40 is substantially sealed, the airspace 110 will be pressurized during the forward stroke of the piston 52. This pressurization of airspace 110 biases the plunger 40 forwardly, away from the piston 52, so as to maintain the volume of the sealed airspace 110 within a predetermined range. Thus, it can be appreciated that the pressurization of airspace 110 drives the plunger 40, and hence the entire striker assembly 30 forwardly, so that the driver member 32 impacts upon the head of the fastener 33. This action can be seen in FIG. 2. It should be appreciated that the initial impact of the driver member 32 releases the fastener 33 from the collation 36.

Figure 2:
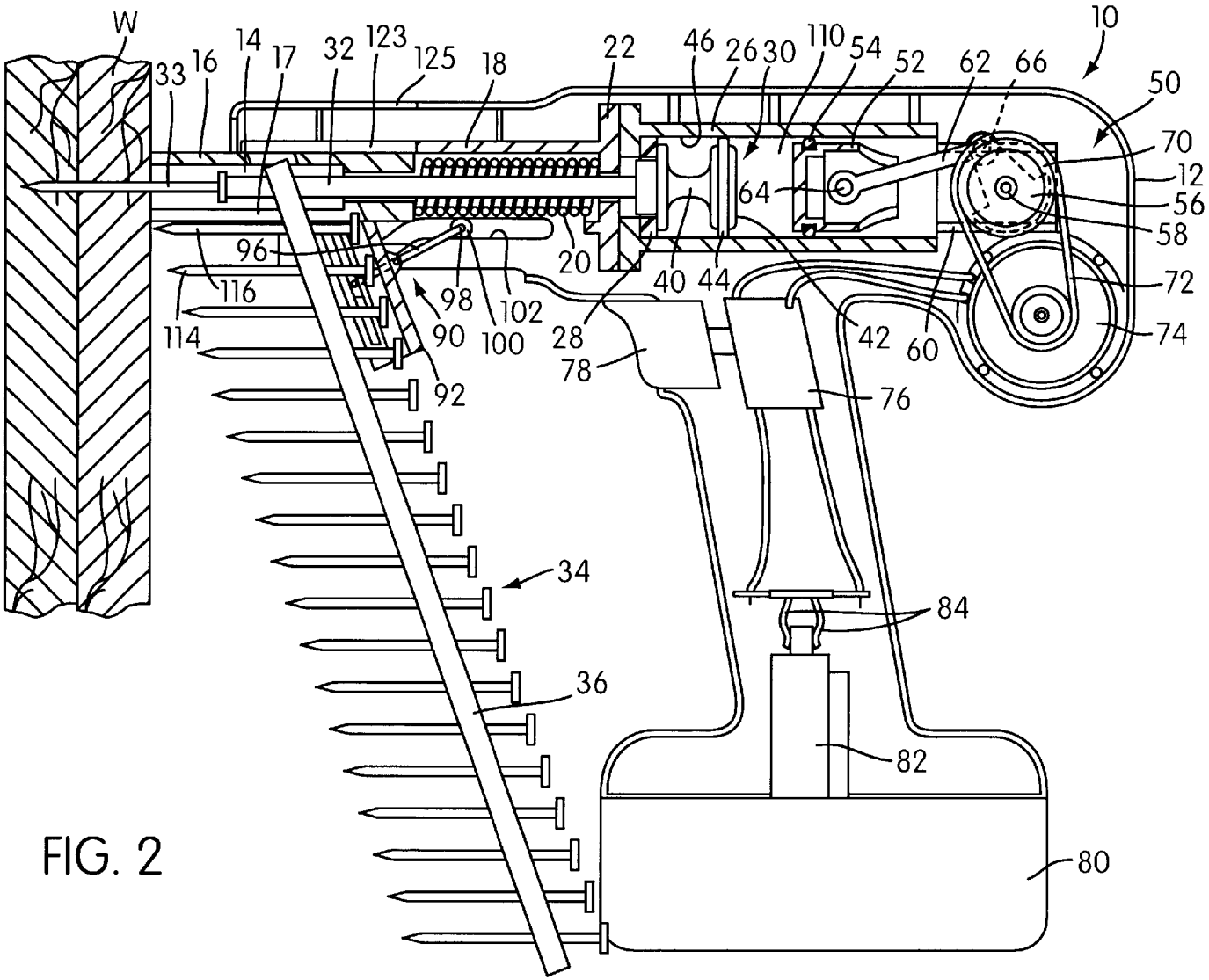
FIG. 2 is a cross-sectional view of the multi-stroke fastening device in accordance with the first embodiment of the present invention illustrating the fastening device mid-way through its drive stroke.

While in FIG. 2, the fastener 33 is shown having approximately two-thirds of its length driven into the workpiece W, it should be appreciated that this would typically be accomplished only after a plurality of impacts or blows upon the fastener head 33. At the bottom or end of each impact drive stroke, the plunger 40 preferably impacts the resilient bumper 28 at the forward end of the guide track 26. It should be appreciated, however, that for certain individual strokes (e.g., towards the end of a fastening operation where extreme forces may be required to finish driving the last bit of the fastener into the workpiece) and/or certain applications (e.g., for particularly hard workpieces) the resistance of the fastener 33 being driven into the workpiece W may serve to stop the movement of the striker assembly 30 prior to the plunger 40 impacting on the bumper 28. It should be appreciated, however, that it is preferred for the plunger 40 to contact the bumper 28 for every stroke for a more consistent operation of the device. In the instance in which the plunger 40 does not contact the bumper 28, it would terminate its forward stroke movement just short of the bumper 28, with minimal spacing therebetween (e.g., less than 5 mm apart). Hence, it can be appreciated that the total impact drive stroke length is fairly constant for each impact stroke.

After each impact stroke, the striker assembly 30 is drawn rearwardly within the guide track 26 as a result of its being resiliently coupled to the power drive assembly 50. More particularly, as the piston 52 is withdrawn within the guide track 26 by the action of crank 56, a vacuum is created in the substantially sealed airspace 110 so as to draw the plunger 40 rearwardly with the piston 52. This can be appreciated from FIG. 2A, where the plunger 40 is shown being drawn rearwardly relative to an impacting position as shown in FIG. 2.

It should be appreciated that the resilient coupling provided by the airspace 110 substantially cushions the driving impact of the striker assembly 30 upon fastener 33. This reduces vibration of the tool and provides for a quieter operation. In addition, after the striker assembly is pulled back by the vacuum in space 110, and the piston 52 instantaneously reverses direction so as to commence forward movement, a pressure pulse or spike in generated in airspace 110, thus creating high levels of kinetic energy for driving the striker assembly forwardly. The airspace 110 in effect acts as an airspring.

It should also be appreciated that because the vibrations of the tool are reduced, the life of the tool 10 can be increased, and the user experiences less fatigue from use of the tool as a result.

The volume of the airspace 110 remains within a predetermined range during the continuous cycling of the device, such that the piston 52 and plunger 40 remain within a predetermined range of distance therebetween. It can be appreciated that towards the end of an impact stroke, the volume of airspace is somewhat reduced after the piston 52 bottoms out on the bumper 28. The volume of airspace is then somewhat increased when the piston is pulled away from the bumper 28 during the return stroke. Similarly, the volume is decreased towards the end of the return stroke as a result of the momentum in the rearward direction of striker assembly 30 and then the instantaneous reversal of direction of the piston into the forward direction. The volume of the airspace 110 is a function of the mass of striker assembly 30, speed of the striker assembly 30, stroke length of the striker assembly 30, among other things. Preferably, the airspace is connected with an overpressurization and underpressurization bleed valve (not shown). Thus, if at any time pressure within the airspace is above or below threshold levels, air will bleed into or out of the airspace to maintain the pressure therein within a predetermined range.

It is desirable to make the striker assembly 30 sufficiently lightweight so that it follows the travel of the piston 52 for each stroke and does not become out of phase with movement of the power drive assembly 50. It is also desirable for the striker assembly to impart as much of its energy as possible to the fastener to be driven, and experience as little rebound as possible. In such manner, a sufficiently large vacuum can be drawn in airspace 110, so that for each stroke the vacuum serves to pull the striker assembly 30 rearwardly, and in phase with the power drive assembly 50, as opposed to rebound of the striker assembly adding a variable that may cause the striker assembly to be forced out of phase with the power drive assembly.

The power drive assembly 50 and striker assembly 30 continue to cycle as described above until the fastener 33 is eventually driven completely into the workpiece W. It should be appreciated that a plurality of impacts is required to drive the fastener into a typical workpiece W, such as wood. For example, it is contemplated that between about five to fifty impact strokes might be used to drive a fastener into a workpiece, depending on the application. It is also contemplated that the power drive assembly 50 would be capable of driving the striker assembly at a rate of about forty to seventy cycles or impact strokes per second, depending upon the application.

As the fastener 33 is driven into the workpiece W, the nose assembly 16 is progressively retracted into the tool housing 12 against the bias of coil spring 20. This action is largely a result of the forward manual force applied by the operator. When the device 10 is used to fasten a horizontal surface, with the nose assembly 16 pointing downwardly (e.g., wood flooring), the weight of the device 10 also assists in movement of the nose assembly into the housing 12 against the force of coil spring 20.

When the fastener 33 is completely embedded in the workpiece W, the nose assembly 16 reaches a point at which it is fully retracted within the nose receiving channel 18. In a preferred embodiment, when the nose assembly reaches this point, the nose assembly 16 engages a contact trip (not shown) which trips a nose switch (that can be included as part of circuit 76) to shut off motor 74 and terminate cycling of the power drive assembly 50 and striker assembly 30. The device 10 can then be pulled away from the workpiece W. As the device 10 is pulled away from the workpiece W, the nose assembly 16 is permitted to extend outwardly from the nose receiving channel 18 and hence, outwardly from the housing 12 under the force of coil spring 20. As the nose assembly 16 is forced outwardly of the nose receiving channel 18, it releases the nose contact trip that shut down motor 74. In a preferred embodiment, circuit 76 will not enable the motor 74 to be energized again until after the nose switch or nose contact trip is released and after the trigger 78 is released and then subsequently depressed again. Alternately, a second contract trip may be provided, and this second contact trip would be activated once the nose assembly 16 reaches the forwardmost position thereof. Activation of the second contact trip would reactivate the motor 74. In this way, the trigger 78 can remain depressed by the operator, and movement of the nose assembly 16 between its fully extended and fully retracted positions would be the means by which to shut off and restart motor 74 between fastening operations. It is desirable for the motor to shut down between fastening operations in order to conserve the power source 80, especially where that source is in the form of a battery.

Figure 2A:
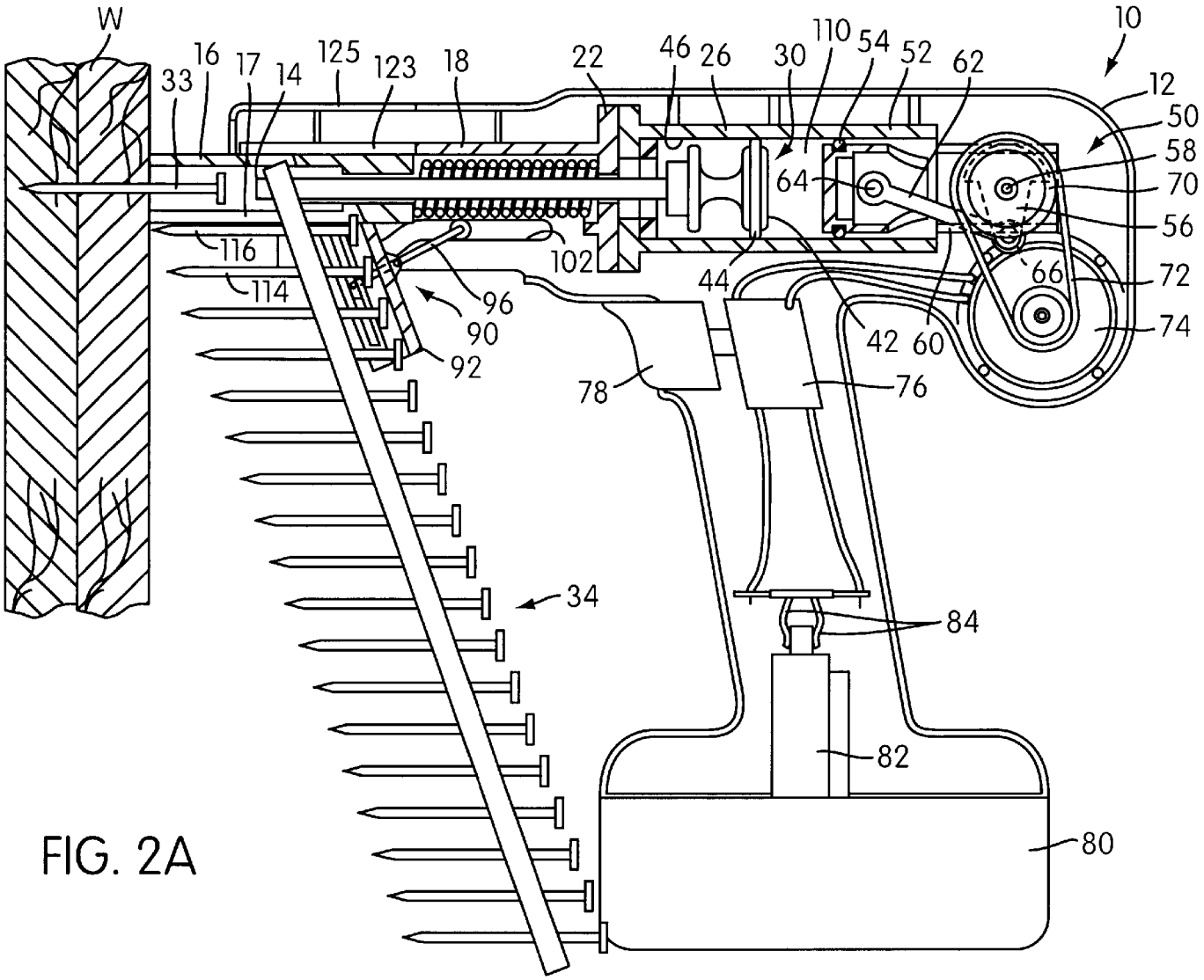
FIG. 2A is a cross-sectional view of the multi-stroke fastening device in accordance with the first embodiment of the present invention illustrating the fastening device during its return stroke.
Figure 3:
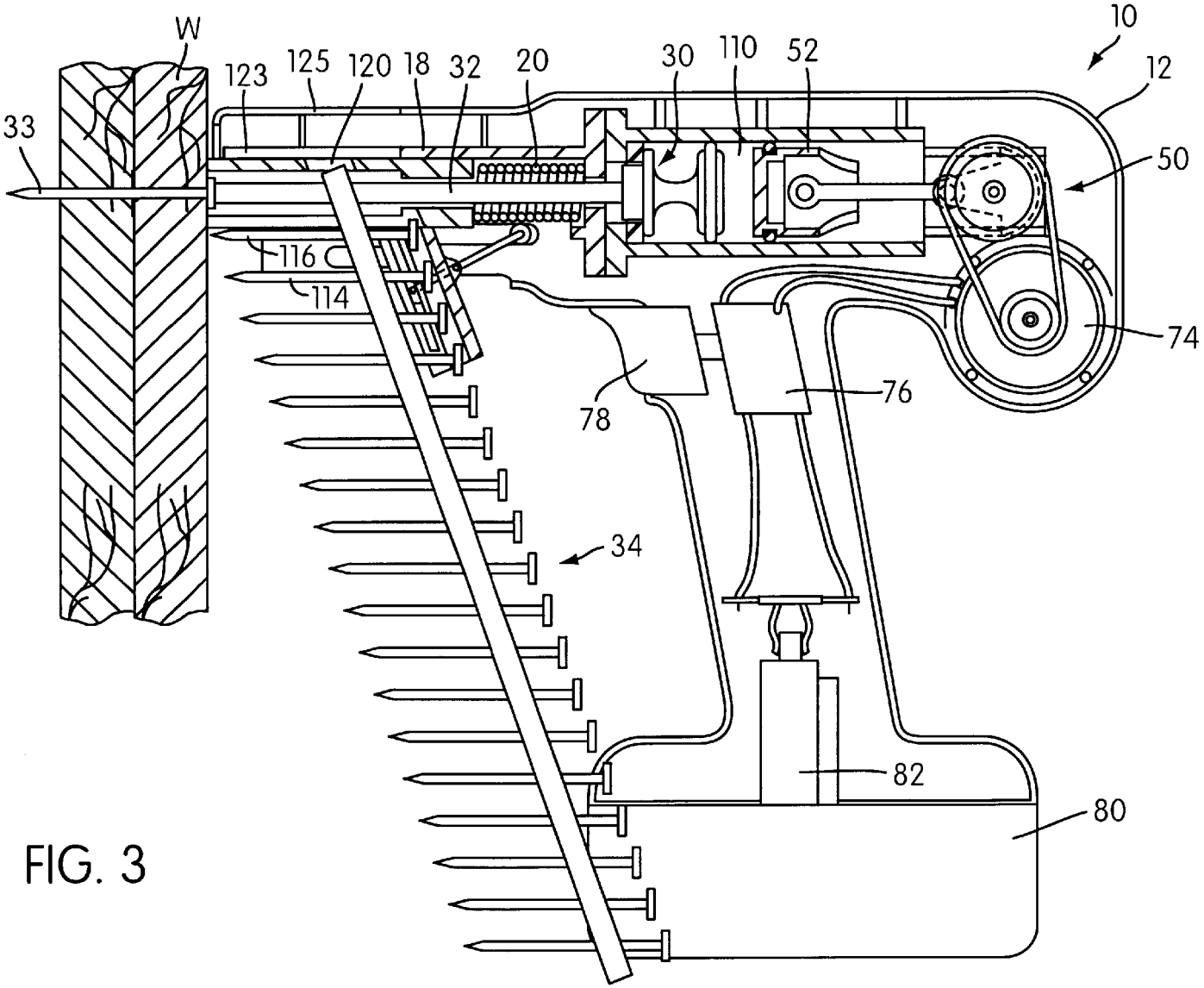
FIG. 3 is a cross-sectional view of the multi-stroke fastening device in accordance with the first embodiment of the present invention illustrating the fastening device as it completes its drive stroke.
Figure 4:
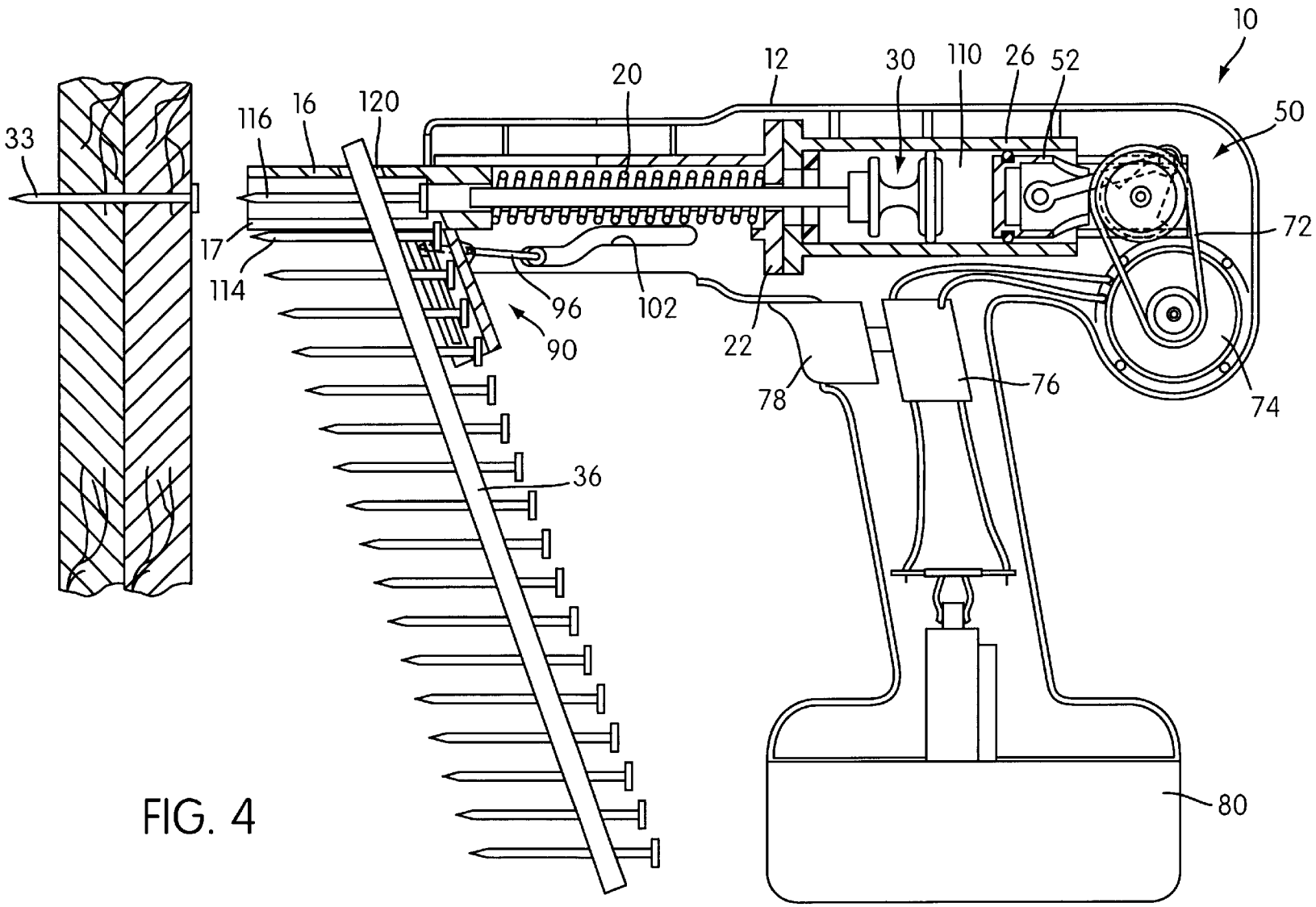
FIG. 4 is a cross-sectional view of the multi-stroke fastening device in accordance with the first embodiment of the present invention illustrating the fastening device in its reset position.
Figure 5:
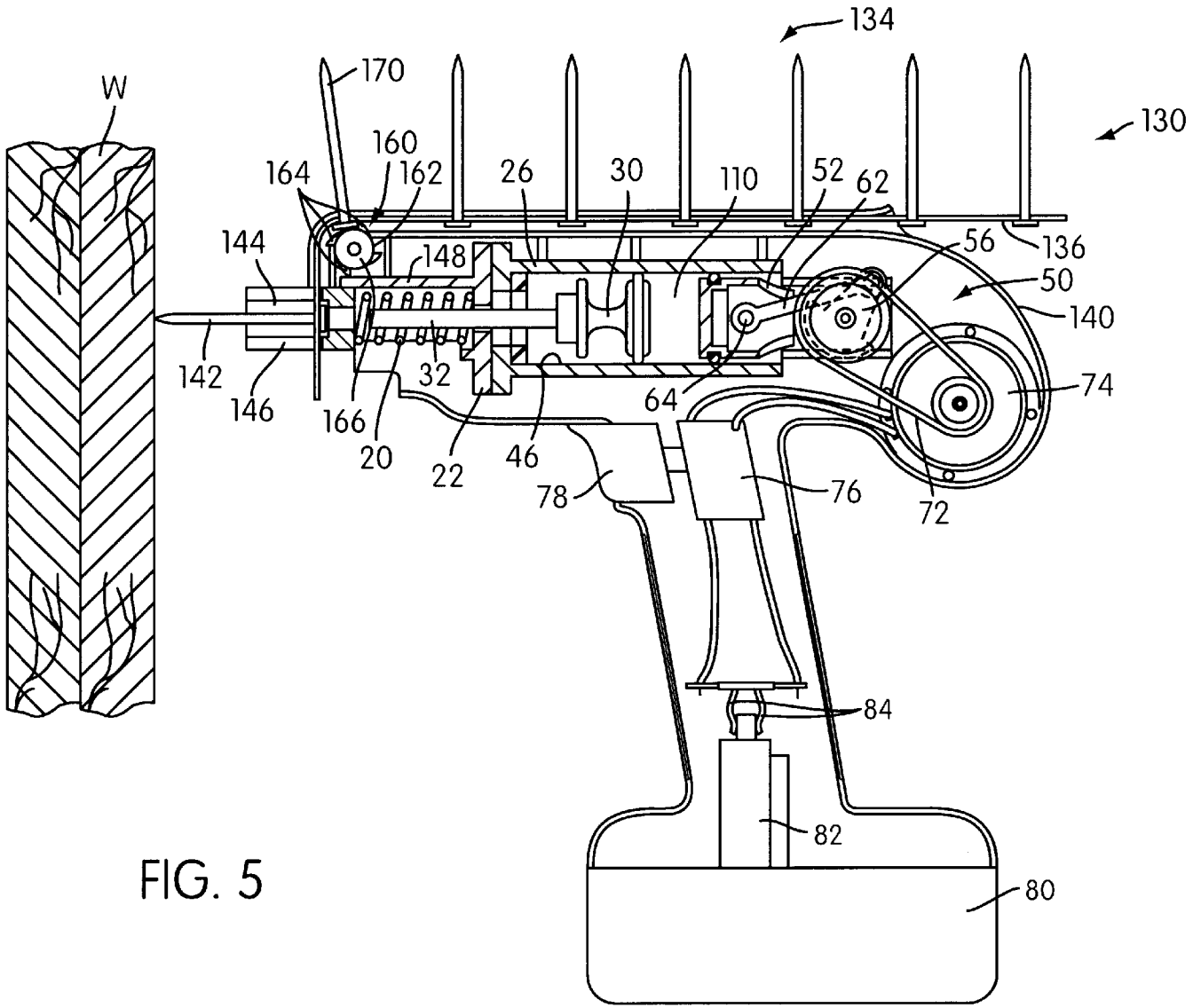
FIG. 5 is a cross-sectional view of the multi-stroke fastening device in accordance with the second embodiment of the present invention illustrating the fastening device at the start of its drive stroke.
Figure 6:
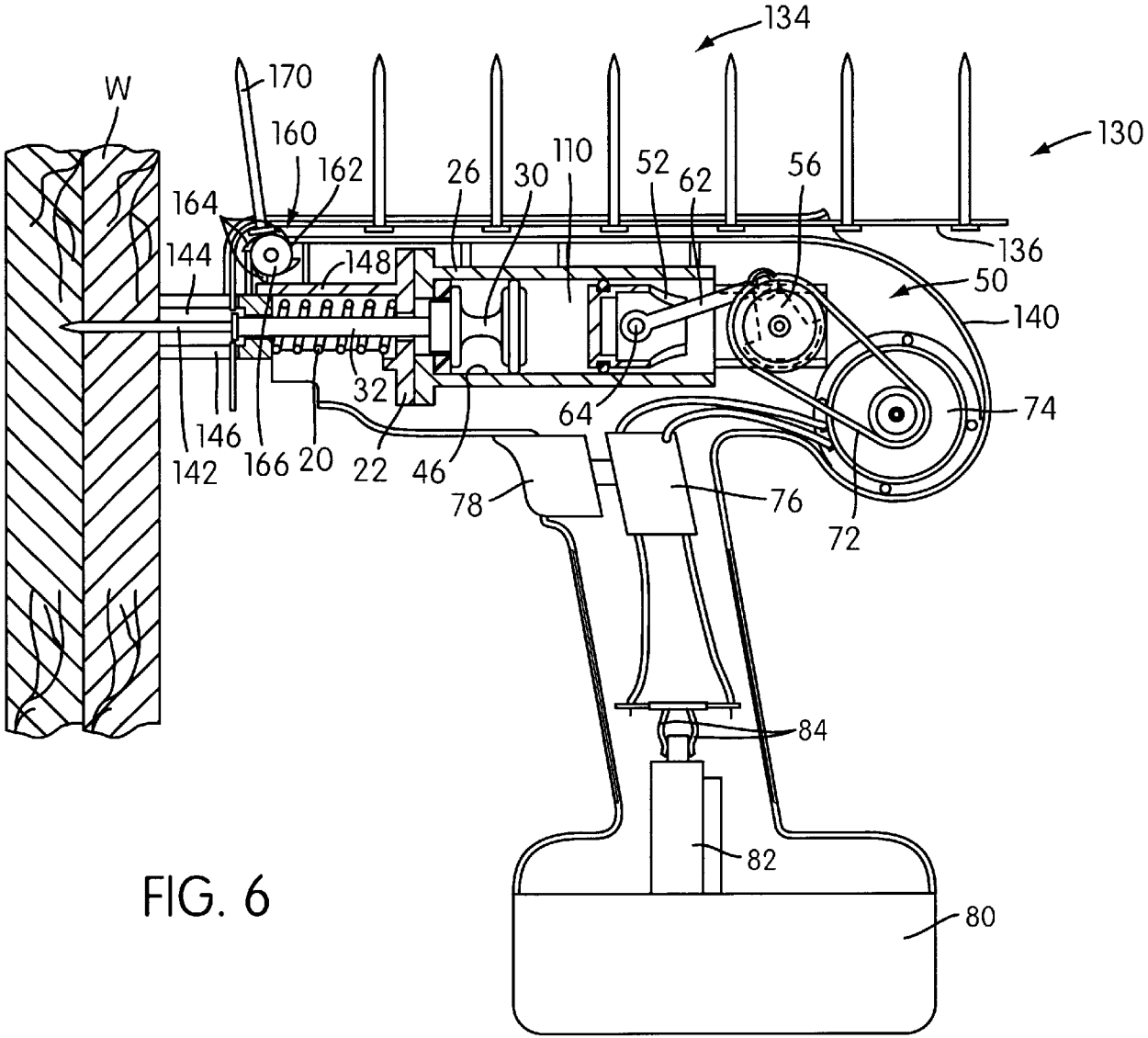
FIG. 6 is a cross-sectional view of the multi-stroke fastening device in accordance with the second embodiment of the present invention illustrating the fastening device mid-way through its drive stroke.
Figure 6A:
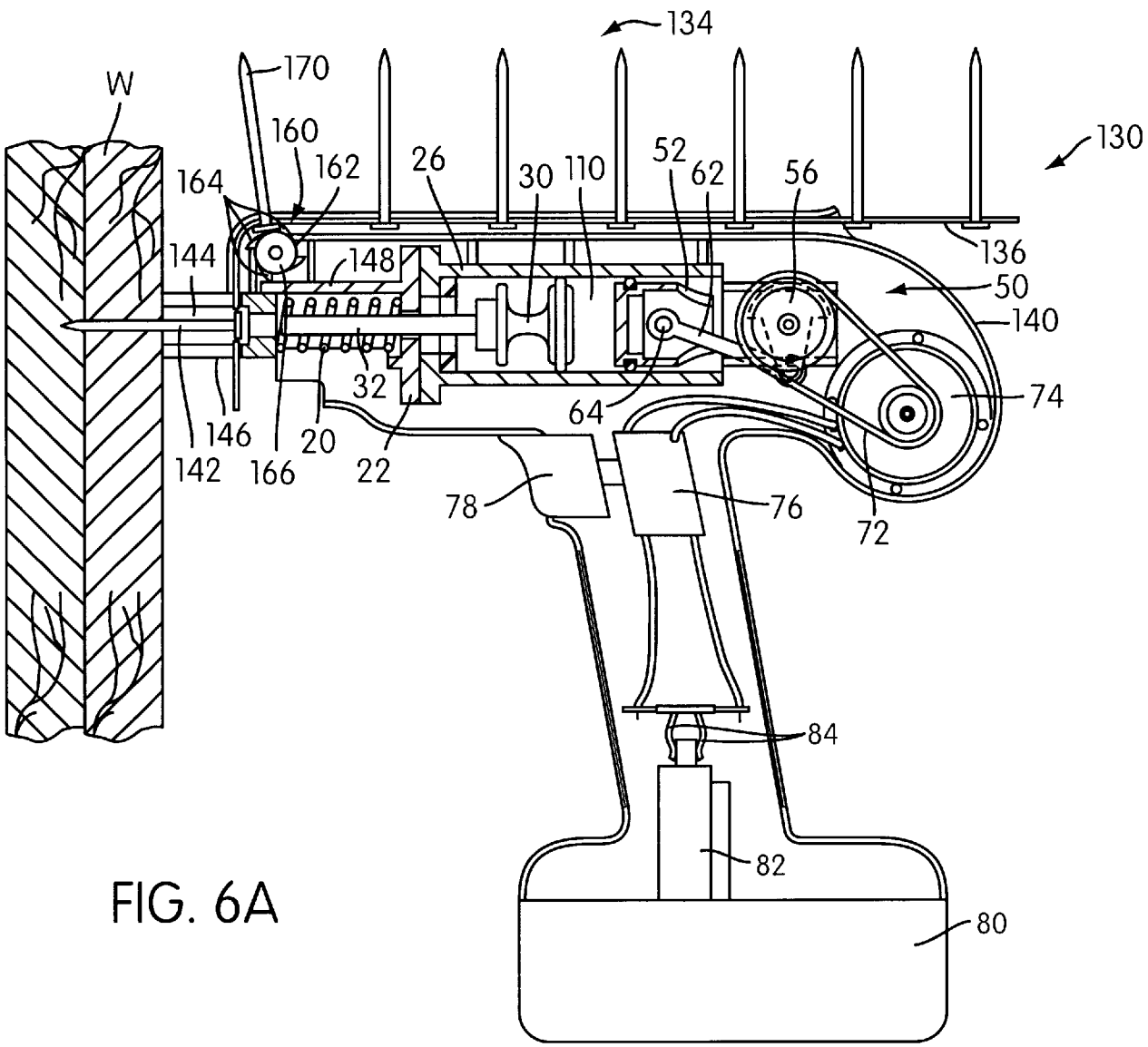
FIG. 6A is a cross-sectional view of the multi-stroke fastening device in accordance with the second embodiment of the present invention illustrating the fastening device during its return stroke.

Shown in the figures, as the rearward end 98 of the feed pawl 96 rides up the ramp surface 102 as the nose assembly 16 is retracted into the nose receiving channel 18, the pawl 96 becomes positioned behind the third fastener 114 (see FIGS. 2, 2A, and 3). When the rearward end 98 of the feed pawl 96 is permitted to ride back down the ramp surface 102 as the nose assembly 16 is forced outwardly of the nose receiving channel 18 after a fastening operation, the forward end of the feed pawl 96 is fully positioned behind the third fastener 114, and the spring bias of torsion spring 100 acting through pawl 96 on the third fastener 114, moves the entire collation of fasteners 34 upwardly so that the second fastener 116 is moved through the slot 17 in the nose assembly 16 and into the drive track 14. The fastener 116 is now in position to be driven in subsequent fastening operations, as illustrated in FIG. 4.

Opening 120 is disposed in the upper portion of the nose assembly 16 for receiving the used collation 36. Similarly, openings 123 and 125 are provided in the nose receiving channel 18 and the housing 12, respectively, to similarly accommodate the spent collation (not shown). Where the collation 36 is made from a paper material (as opposed to plastic or metal), it may not be necessary to provide for any exit thereof, as it will be substantially disintegrated.

FIGS. 5–8 illustrate a second embodiment in accordance with the principles of the present invention, generally indicated at 130. Operation of the second embodiment is quite similar to that of the first embodiment, and hence, corresponding components are illustrated with the same reference numerals as in the first embodiment. The differences between the first embodiment and this second embodiment will be described with particularity.

Figure 7:
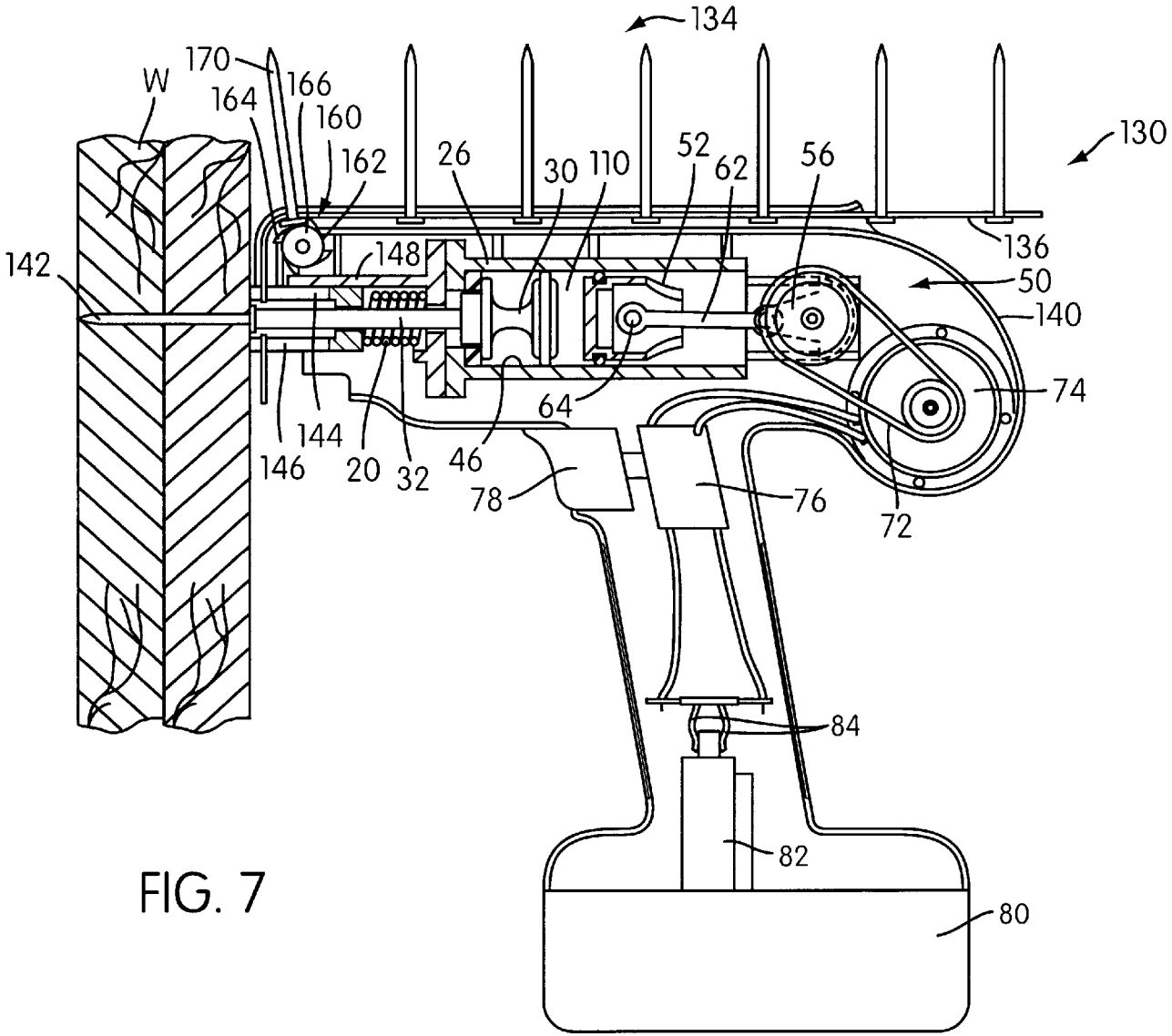
FIG. 7 is a cross-sectional view of the multi-stroke fastening device in accordance with the second embodiment of the present invention illustrating the fastening device as it completes its drive stroke.
Figure 8:
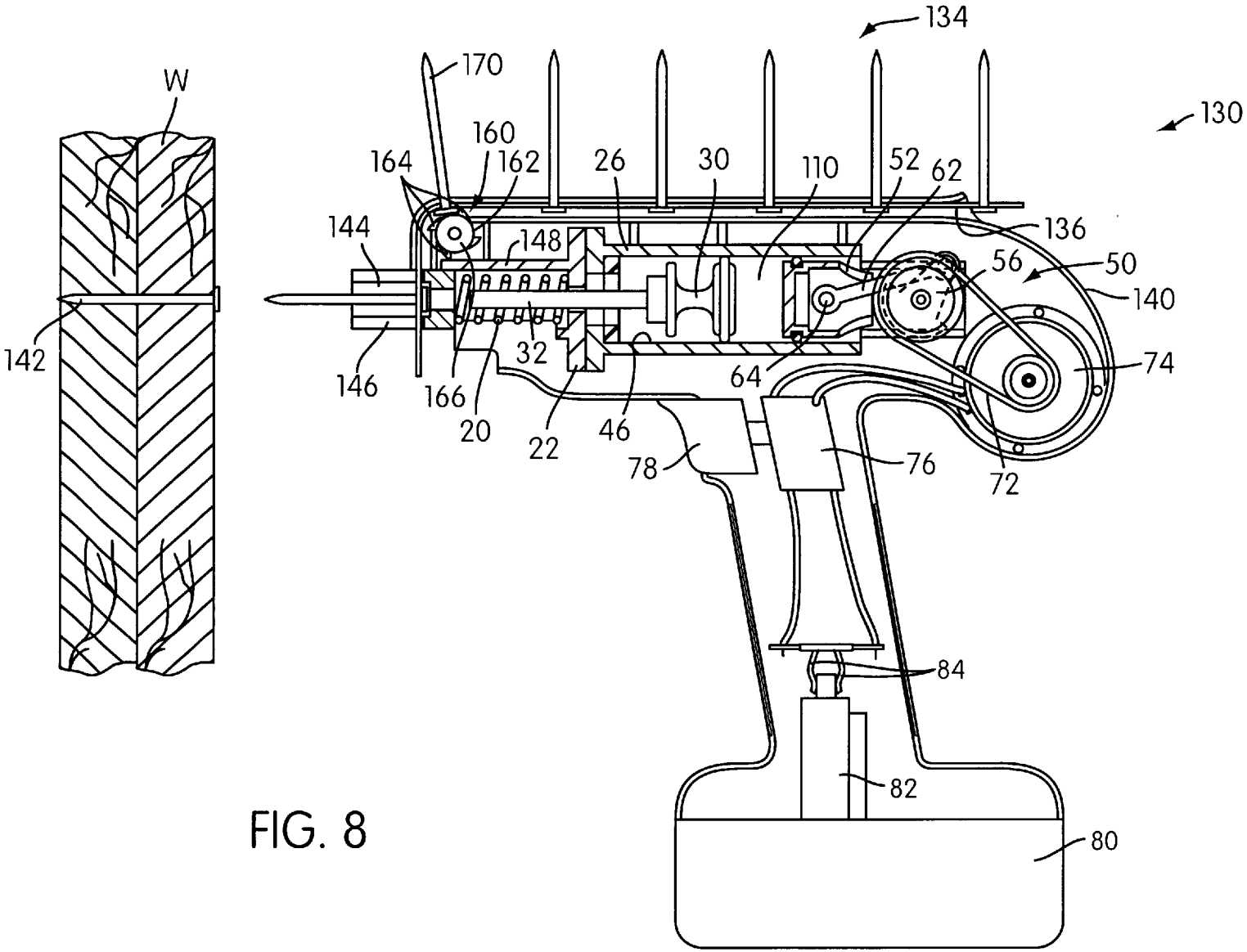
FIG. 8 is a cross-sectional view of the multi-stroke fastening device in accordance with the second embodiment of the present invention illustrating the fastening device in its reset position.

In accordance with the second embodiment of the present invention, the fastening device employs an array of collated fasteners 134, but preferably utilizes a more flexible collation 136 to connect the fasteners to one another. The collation 136 and the heads of the fasteners are manipulated through a longitudinal slot in the top of clam shell housing 140. As shown, a first fastener 142 is disposed in the drive track 144. The fastener 142 is driven essentially in the same fashion as described with respect to fastener 33 in the first embodiment. At the completion of a fastening operation (as illustrated in FIG. 7), movement of the nose assembly 146 into its retracted position within the nose receiving channel 148 causes the nose contact trip or switch to be tripped, thereby causing circuit 76 to terminate operation of the motor 74 and hence, the power drive assembly 50. When the device 130 is pulled away from the workpiece W (see FIG. 8), a feed mechanism 160 is actuated (either by release of the first contact trip or by use of a second contact trip activated by movement of the nose assembly 146 to its extended position). The feed mechanism 160 comprises a ratchet wheel 162. Preferably, the ratchet wheel 162 has a plurality of radially extending prongs 164, which are resiliently biased outwardly via internal springs to project outwardly from a main wheel portion 166 of the feed mechanism. The prongs 164 are constructed and arranged such that engagement thereof by a structure running circumferentially or tangentially to the periphery of wheel portion 166 in one direction will move the prongs 164 inwardly, while engagement thereof in an opposite direction will not, as will be appreciated more fully from the following further description. Although not shown, the ratchet wheel 162 is connected by a gear train to the nose assembly 146, as can be appreciated by those skilled in the art. When the nose assembly 146 is retracted during a fastener driving operation, the ratchet wheel 162 is rotated in a clockwise direction as viewed in FIGS. 5–8. During this clockwise rotation, the radially extending spring biased members 164 have convex cam surfaces that are permitted to ride over the head of the next fastener 170 and are forced inwardly against the internal spring bias thereof. In contrast, when the nose assembly 146 is extended from the nose receiving channel 148 after a fastener driving operation, the ratchet wheel 162 is rotated in a counter-clockwise direction (relative to the Figures shown). With this action, concave catching surfaces of the resiliently biased projections 164 engage the head of the next fastener 170 and drive the same into the drive track 144 for the next fastening operation.

In accordance with the second embodiment, the front end of the device 130 can be made somewhat smaller in comparison with that of the first embodiment.

Figures 9A, 9B:
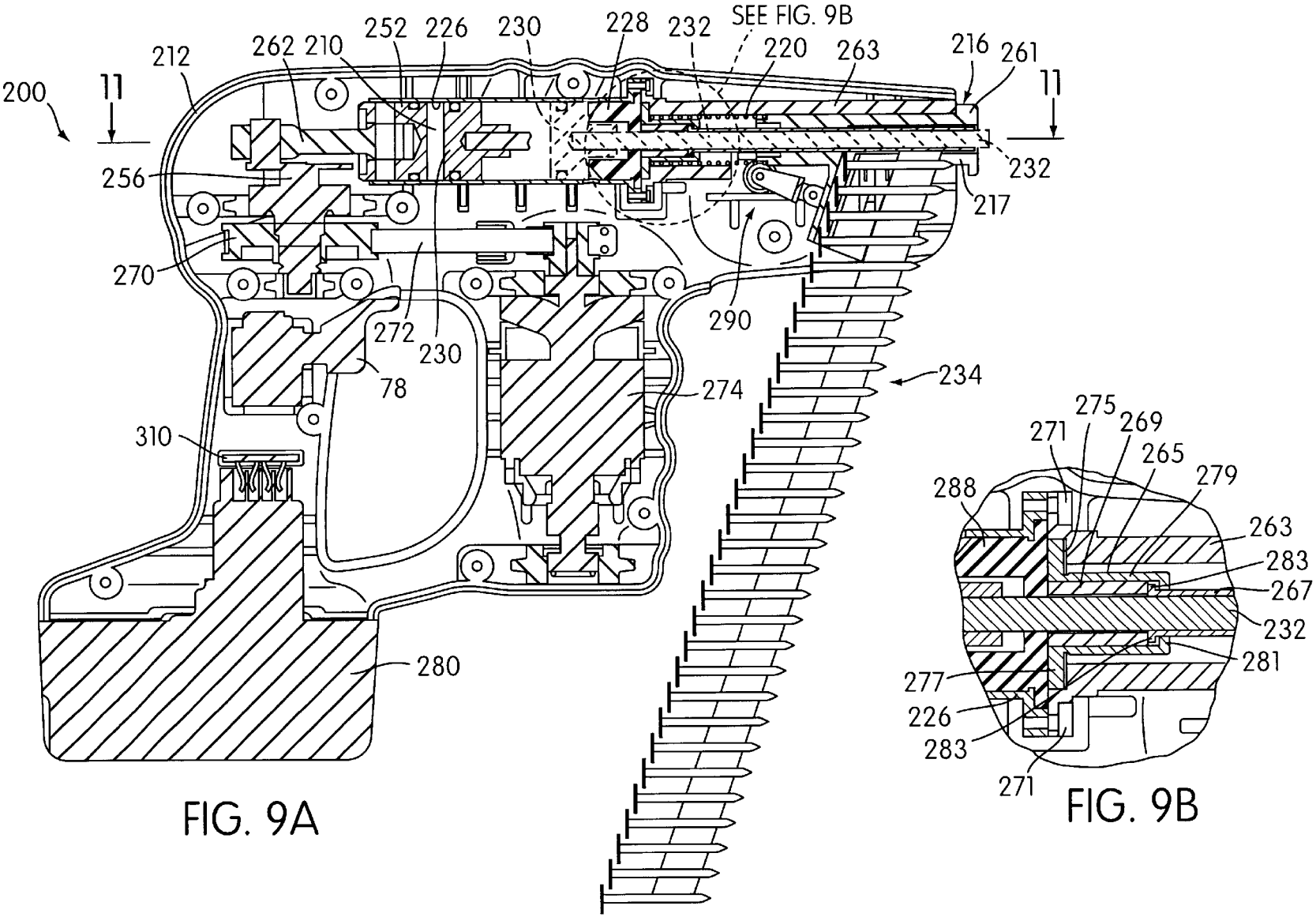
FIG. 9A is a cross-sectional view of the multi-stroke fastening device in accordance with a further embodiment of the present invention.
FIG. 9B is an enlarged view of circled section B in FIG. 9A.

FIG. 9A is a cross-sectional view of a further embodiment of a multi-blow fastening device, generally indicated at 200, in accordance with the principles of the present invention. FIG. 9B is an enlarged view of circled section B in FIG. 9A. The device 200 is the same in many respects as the device illustrated in FIG. 1. For example, the multi-blow fastening device 200 has a housing 212, a cylindrical striker assembly guide track 226, piston 252 within the cylindrical track 226, plunger 240 connected with a driver member 232, airspace 210, crank arm 262, crank 256, pulley 270, belt 272, motor 274, feed mechanism 290, an elastomeric bumper 228, and a battery 280, all as described above with respect to the first embodiment, and need not be repeated here. Driver member 232 together with plunger 240 constitute what may be termed a striker assembly or driver assembly 230, a forward position of which is shown in phantom lines and a rearward position of which is shown in partial cross section. The piston 252 is shown in its rearward position only. It will be appreciated by those skilled in the art that other specific details of the embodiments of FIGS. 1–8 (such as with respect to an exit for the spent collation) may also be applied to the embodiments of FIGS. 9–18 and not be repeated here. The device of 200 differs from the first embodiment most significantly towards the front end of the device 200 that interfaces with the fasteners to be driven.

Specifically, the device 200 includes a nose assembly 216 mounted in the housing 212. The nose assembly 216 preferably includes a channel-like nose member 261 which is spring biased forwardly by a coil spring member 220. The nose member 261 receives collated fasteners 234 through a lower slot 217 in the nose member 261. The nose member 261 of the nose assembly defines a drive track along which the forward end of driver 232 travels during the drive strokes and return strokes.

The nose member 261 is mounted for longitudinal, axial sliding movement within a nose receiving channel member 263. More specifically, as shown best in FIG. 11, which is a sectional view taken through the line 11—11 in FIG. 9A, the nose receiving channel member 263 is provided with a pair of nose guide members 266 extending laterally inwardly openings 299 through the housing 212, and threadedly received in threaded bores in the side wall of the channel member 263. The forward ends of guide members 266 are received in respective grooves or channels 268 formed in opposite sides of the nose member 261. The engagement of guide members 266 with channels 268 enable the nose member 261 to be slidably mounted within channel member 263. The length of channels 268 limits the longitudinal travel of the nose member 261.

Figure 12:
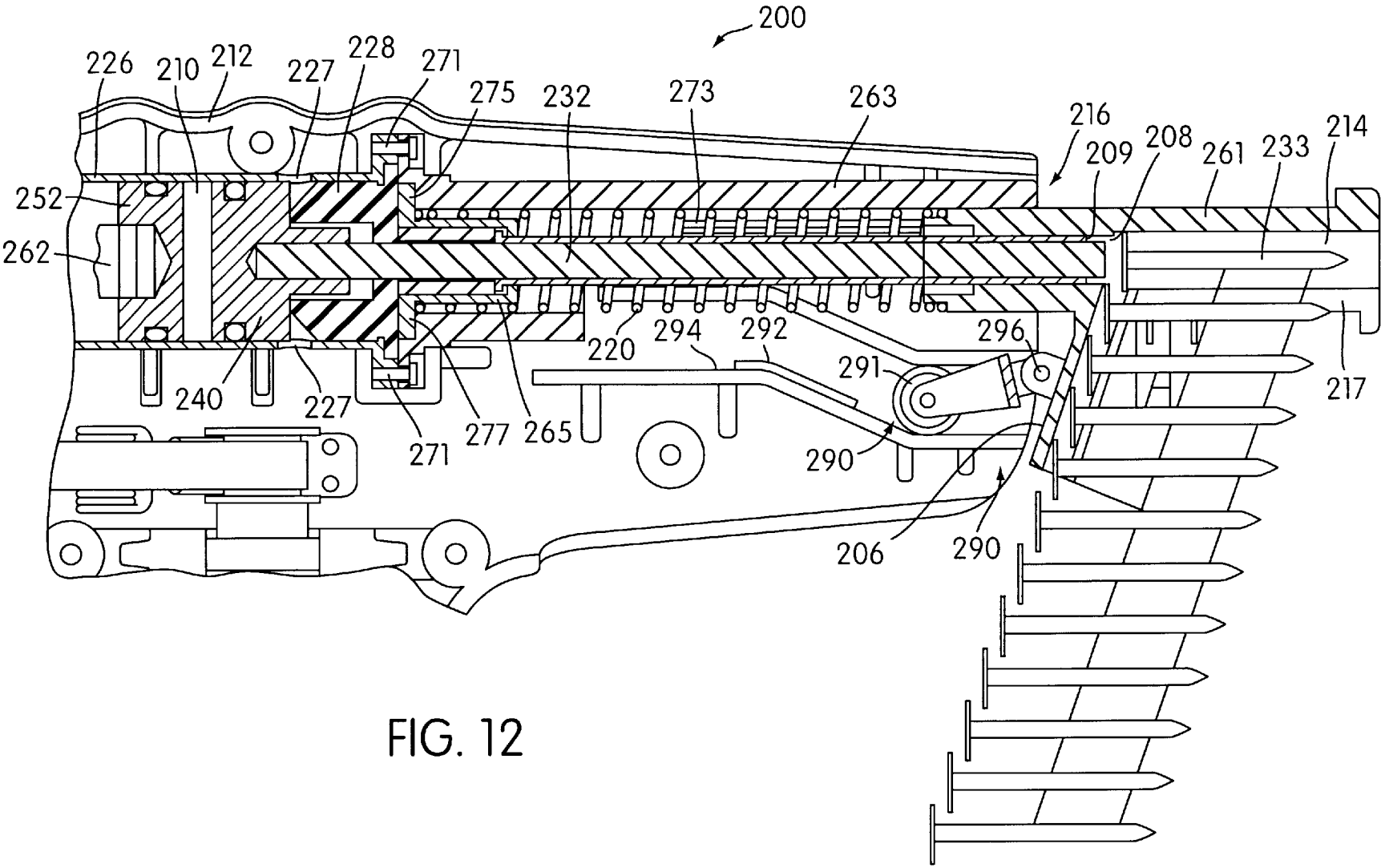
FIG. 12 is an enlarged cross-sectional view of the multi-stroke fastening device in accordance with the embodiment of FIG. 9A illustrating the fastening device at rest.

As can be appreciated from FIG. 12, the nose receiving channel 263 is a generally cylindrical tubular structure, preferably having a portion of its circumference (preferably about 50°) cut-away towards the forward bottom portions thereof to enable the nose receiving channel 263 to receive the lower feed track portion 206 of nose member 261 as it moves rearwardly into the tool against the force of spring 220 during a fastener driving operation. The nose receiving channel 263 may also be provided with one or more longitudinally extending interior tracks or ribs 273 that cooperate with corresponding tracks or ribs (not shown) on the external surface of the nose member 261 so that the nose member 261 can slide in controlled fashion relative to the channel 263.

Figure 10:
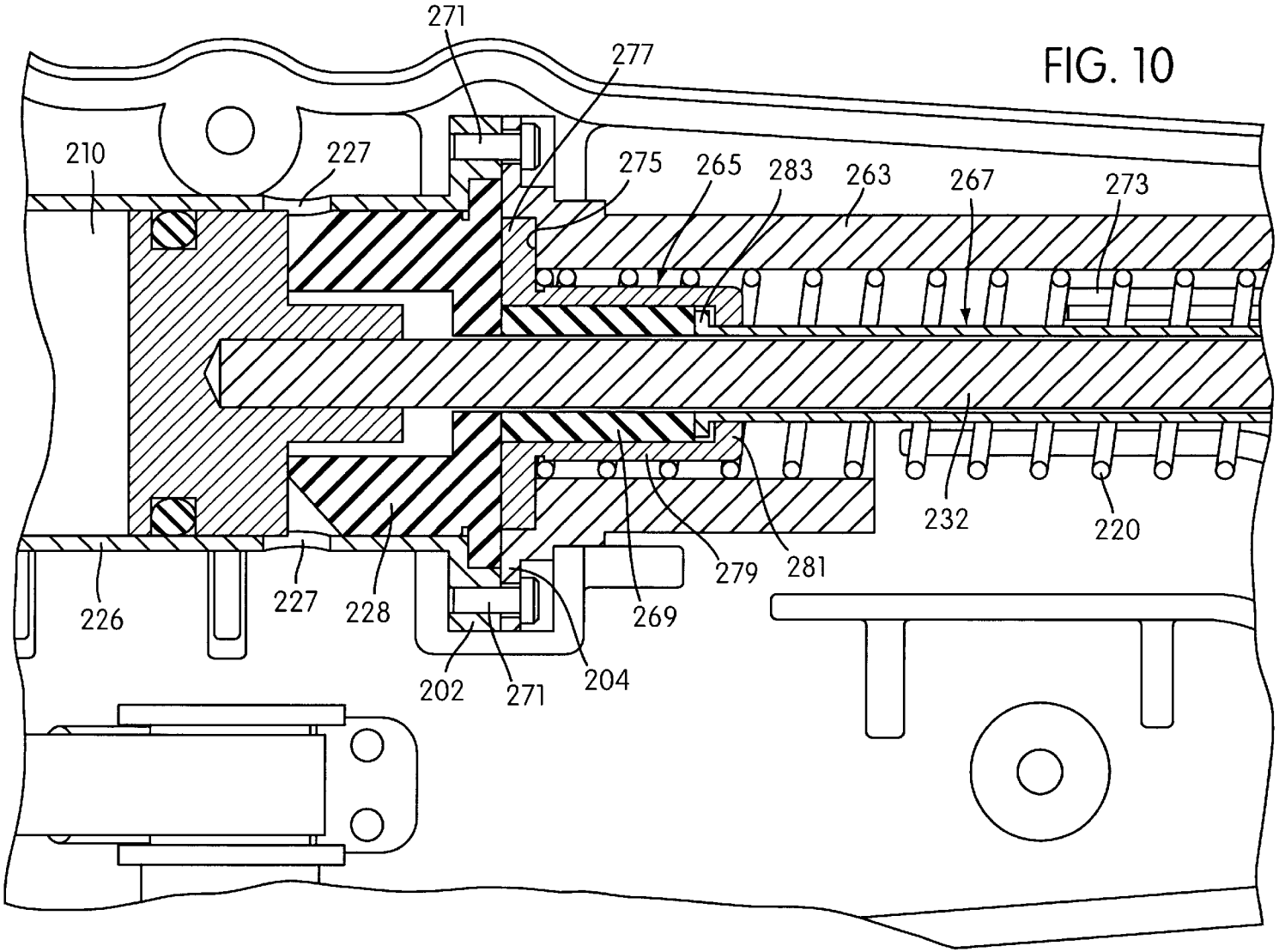
FIG. 10 is an enlarged view of the head of the fastener device illustrated in FIG. 9.
Figure 11:
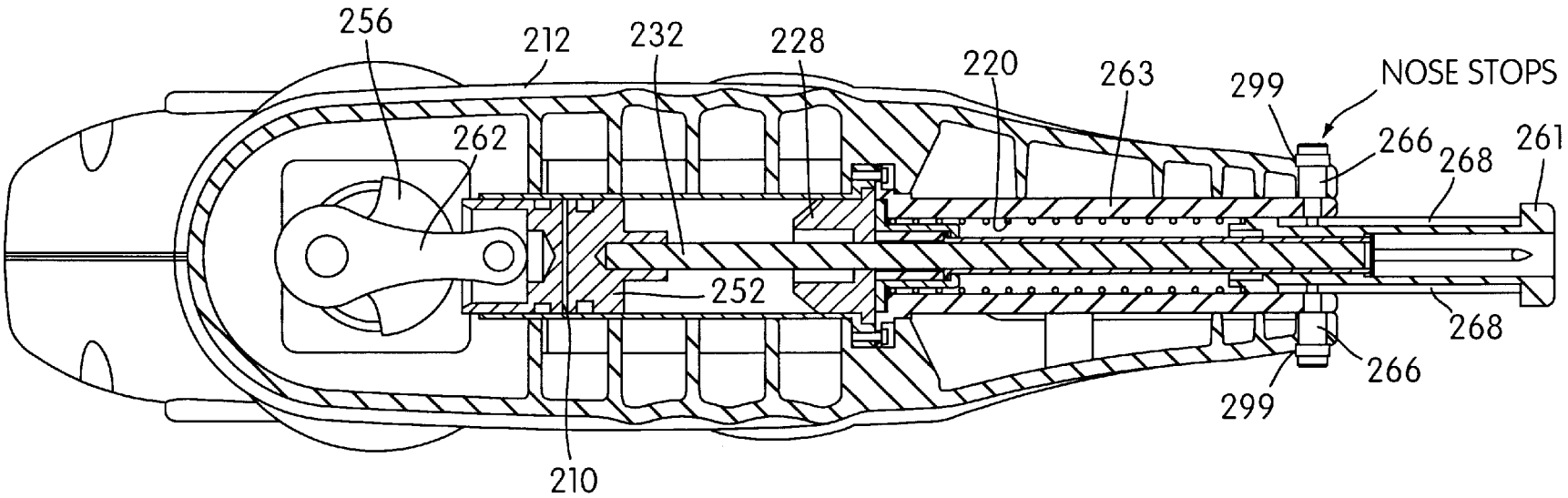
FIG. 11 is a sectional view taken through line 11—11 in FIG. 9A.

As can be seen best in FIG. 10, the nose receiving channel member 263 is fixed to the housing 212 and also has its rearward end fixed to the forward end of the striker assembly guide track 226 by appropriate fasteners 271 extending through respective abutting annular flanges 202,204 of the guide track 226 and of the nose receiving channel 263, respectively. The preferred guide track 226, as with the previous embodiments, is a cylindrical tubular structure and has an air vent 227 towards the forward end thereof (see FIG. 10) that vents displaced air from in front of the plunger 240.

The connection between the nose receiving channel 263 with the striker assembly guide track 226 also serves to secure a mounting structure 265. Specifically, as best seen in FIG. 10, which is an enlarged sectional view of a portion of FIG. 9A, an annular recess 275 is formed in the rear end of nose receiving channel member 263 to receive an annular flange 277 of the mounting structure 265. The mounting structure 265 has a main cylindrical portion 279 extending axially in parallel relation to the nose receiving channel 263. The forward end of the mounting structure 265 has a radially inwardly projecting flange 281, which terminates in slidable abutting relation with the cylindrical outer surface of a fastener head engaging structure 267. More specifically, the fastener head engages structure 267 is generally tubular member having a rearward end telescopingly received in the mounting structure 265. The forward end portion of fastener head engaging structure 267 is received within an axial bore 208 in the nose member 261, as seen in FIG. 12.

Referring back to FIG. 10, a radially outwardly projecting flange 283 at the rear end of the fastener head engaging structure 267 has a forward surface thereof abutting against the flange 281 of the tubular mounting structure 265 so that the rear end of the fastener head engaging structure 267 is retained within the mounting structure 265.

The fastener head engaging structure 267 acts as a guide tube for the driver member 232 received therethrough. The fastener head engaging structure 267 also serves to engage the head of a fastener being driven and to maintain the fastener in spaced relation, at a predetermined spaced distance, from the guide track 226 throughout a drive stroke.

As shown in FIG. 9B, the cylindrical portion 279 of the mounting structure 265 has a diameter which is sufficiently large so as to be radially outwardly spaced from the driver 232. Disposed within this space is a resilient elastomeric tubular structure 269 generally cylindrical in shape. The forward annular edge of the resilient structure 269 engages the rearward surface of the annular flange 283 of fastener head engaging structure 267. The rearward annular edge of the resilient structure 269 engages the forwardly facing surface of the resilient bumper 228. Preferably, the resilient structure 269 is formed from a rubber-based material, as is the bumper 228.

In another preferred arrangement (not shown), the resilient structure 269 is integrally formed (integrally molded) with the bumper 228, as opposed to being a separate structure as shown.

As best seen in FIG. 10, the resilient structure 269 is operatively coupled to the fastener head engaging structure 267 (by being engaged therewith) to permit limited longitudinal movement of the fastener head engaging structure 267 relative to the striker assembly guide track 226. The resilient structure 269 is constructed and arranged to dampen the engagement (and any slight impact) between the forward end of the fastener engaging structure 267 and the head of a fastener being driven (see FIGS. 13 and 14). Specifically, the resilient structure 269 is longitudinally compressed or stressed by the fastener head engaging structure 267 under the force and weight of the tool bearing upon the fastener being driven (see FIG. 14). When the driver member 232 impacts the head of the fastener with each stroke, the head of the fastener being driven may become slightly forwardly spaced from the forward, annular fastener engaging surface 209 of the fastener head engaging structure 267. When the driver member 232 is retracted, the force of gravity acting on the device 200 and/or the application of force by the user to the device 200 maintains the forward edge 209 of the fastener head engaging structure 267 in contact with the head of the fastener being driven. Any slight impacts between the forward edge 209 and the head of the fastener being driven are damped by the resilient structure 269.

Figure 13:
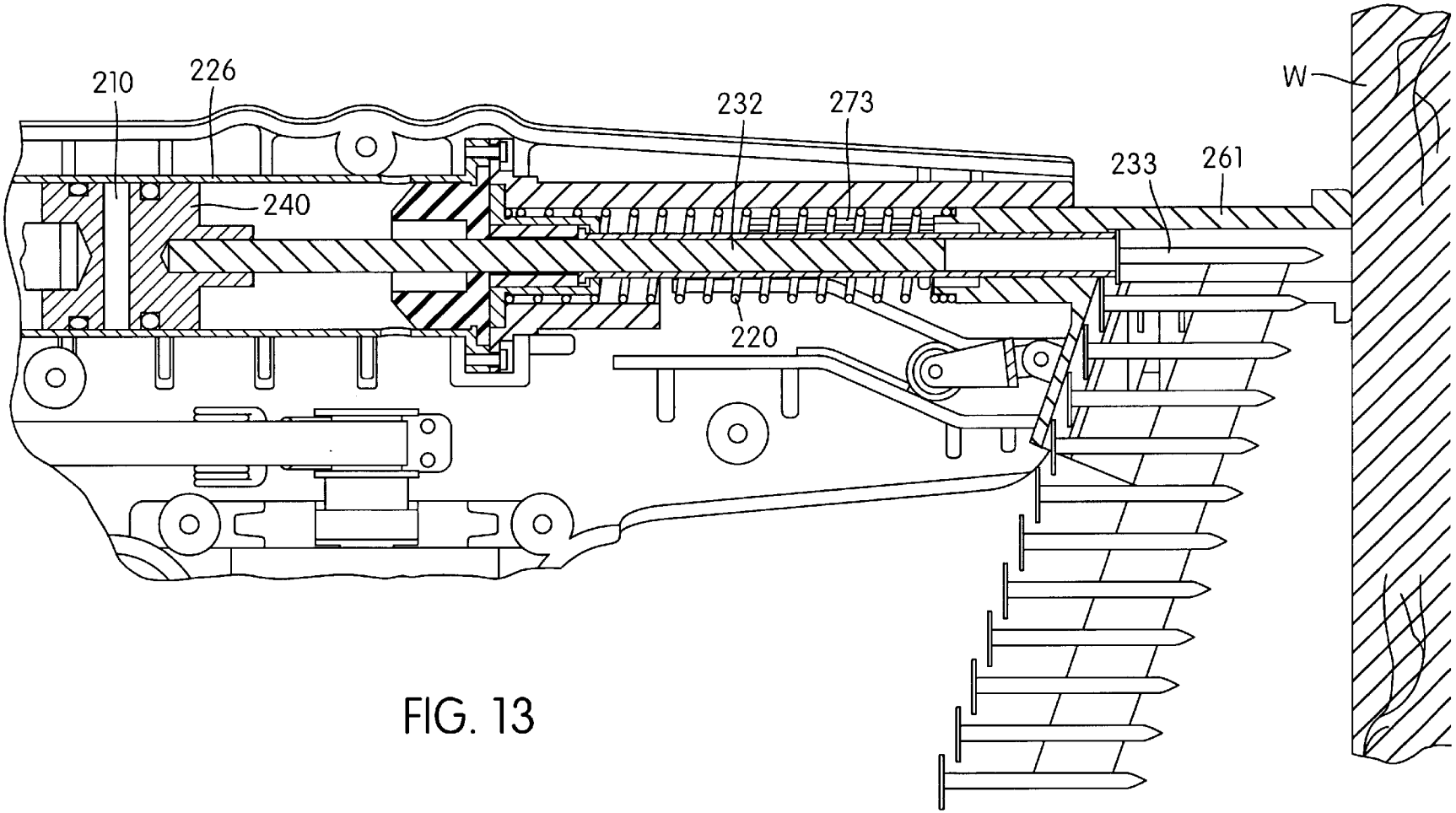
FIG. 13 is a cross-sectional view of the multi-stroke fastening device in accordance with the embodiment of FIG. 9A illustrating the fastening device at an initial stage of operation.

FIG. 12 illustrates the device 200 at rest, prior to cycling of the driver member 232, and with a fastener 233 disposed in the drive track 214. The nose member 261 is in its fully extended position under the force of coil spring 220. FIG. 13 illustrates an initial stage of tool operation, i.e., the user has pulled the trigger and has forced the forward end of nose member 261 against a workpiece W to compress spring 220 a predetermined distance to activate a nose switch 292 connected with a control circuit that commences cycling of the plunger 240 and driver 232. The feed mechanism 290 has a roller 291 that rides along a track 294 as the nose element 261 is forced against a workpiece and moves into the housing 212 against the bias of coil spring 220. When the roller 291 reaches a contact portion 292 of a nose switch, which contact portion is disposed along the track 294, control circuitry within the tool causes motor 274 is energized to commence cycling of the tool. The nose switch contact portion 292 is illustrated schematically, and the electrical connection between the nose switch contact portion 292 and motor 274 is not shown, nor is the control circuit shown in detail, as those skilled in the art will appreciate that these types of elements and connections can be one of several different known constructions and still fall within the scope the present invention. When the nose switch contact trip 292 remains depressed, the tool continues to cycle. When the roller 291 rides past the mechanical contact portion 292 after the nose assembly is forced into the housing (which in the embodiment shown is in the form of an elongated button) the control circuit sends a signal to shut down the motor (or in a contemplated embodiment, first slows down the motor to a fraction of its duty cycle before completely shutting the motor down).

As the tool is subsequently pulled away from the workpiece, the nose assembly is permitted to project outwardly from the housing, and the roller rides down a different, adjacent return path, which is parallel to the surface 294 so that it does not depress contact portion 292 on its return as the nose is extended out from the housing after a fastening operation. This can be accomplished by a cross-over railroad track type intersection.

As an alternative to an elongated contact portion 292, the roller 291 may be provided with a cam follower that maintains engagement with a smaller contact portion 292 as the nose assembly is moved into the housing, but releases the contact portion once the nose assembly is moved fully into the housing. In any event, the contact portion remains depressed until the nose assembly is substantially fully received within the housing, at which point the contact portion is released to permit the circuit and motor to terminate the fastening cycle.

Figure 14:
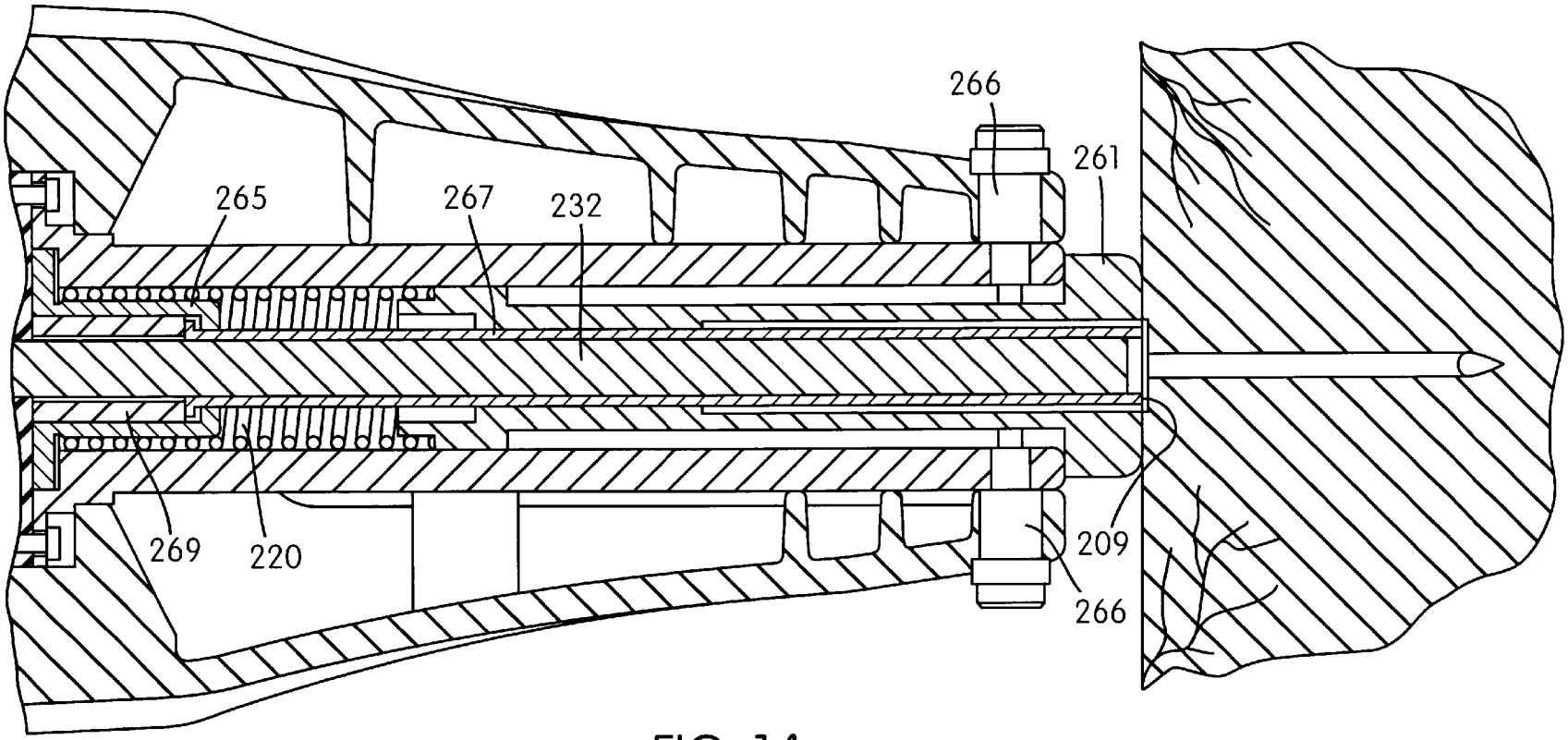
FIG. 14 is an enlarged partial sectional view of the multi-stroke fastening device in accordance with the embodiment of FIG. 9A illustrating the fastening device at the end of a fastening operation.

As the roller 291 rides up ramp 295 of the track 294 as the tool is pressed against a workpiece to commence a fastening operation, the feed mechanism 290 pivots about a pivot 296 to enable a feed pawl (also not shown) to engage the collated fasteners 234 and move a lead fastener 233 into the drive track 214. As shown in FIG. 13, the plunger 240 has commenced its initial retraction within the guide track 226, however, it should be appreciated that the present embodiment contemplates that initial movement of the plunger 240 need not commence at this stage. Rather, it is possible to design the tool such that it only commences cycling after the nose member 261 is sufficiently moved rearwardly within the tool a sufficient distance such that the forward point of fastener 233 engages workpiece W. FIG. 14 is an enlarged partial sectional view similar to FIG. 11, but illustrates the device 200 towards the end of a fastening operation.

The resiliency of the resilient structure 269, the length of driver member's 232 forward extension beyond the forward end of fastener head engaging structure 267 during the drive stroke, the downward force applied when using the tool, among other factors, may have a bearing on the separation between the head of the fastener being driven and the forward surface 209 of the fastener head engaging structure 267. In any case, it should be appreciated that the resiliency of the resilient structure 269 minimizes the distance of, or can practically eliminate the disengagement between the fastener head engaging structure 267 and the head of the fastener being driven during the drive and return strokes. That is, when the forward end of the driver member 232 extends forwardly of the fastener contacting forward edge of fastener head engaging structure 267, the resiliency of the resilient structure 269 enables the fastener contacting edge of the fastener head engaging structure 367 to remain closely coupled with or remain only slightly spaced from the head of the fastener with each stroke. The resilient structure 269 is compressed slightly during each return stroke under the weight (force) of the tool, and decompresses slightly at the end of each drive stroke to maintain the close engagement between the fastener head engaging structure 267 and the head of the fastener being driven.

By providing the resilient structure coupled with fastener head engaging structure, the operation of the tool becomes much smoother and vibrations are effectively damped, thus eliminating tool bounce off the fastener.

The fastener head engaging structure 267 maintains the head of the fastener being driven spaced a predetermined distance relative to the guide track 226, which distance varies essentially only as a function of the resilience of the resilient structure 269. Preferably, the resilient structure 269 is made from a urethane material, which is the same urethane material that forms bumper 228.

In this preferred embodiment specifically described and shown, the fastener head engaging structure 267 is formed as a separate structure from the nose assembly 216. It is contemplated, however, that the fastener head engaging structure 267 may constitute part of the nose assembly 216 in alternate embodiments contemplated by this invention.

It will be appreciated from the above that the objects of the present invention have been fully and effectively accomplished. One skilled in the art will appreciate, however, that the present invention can be practiced by other than the described embodiments, which are presented for purposes of illustration and not limitation. Thus, the present invention encompasses all modification within the spirit and scope of the following claims.

What is claimed is:

1. A multi-stroke fastening device for driving fasteners into a workpiece, comprising:

a housing;

a fastener drive track carried by said housing;

a striker assembly guide track mounted within said housing and having an internal surface;

a striker assembly mounted in slidable relation within said guide track and including a driver member constructed and arranged to strike a fastener disposed in said fastener drive track, said striker assembly being moved along said guide track through a plurality of alternating drive strokes and return strokes to effect a plurality of impacts of said driver member upon said fastener;

a power drive assembly resiliently coupled to said striker assembly, said power drive assembly including a slidable portion slidably received in said guide track and having a forward surface, said striker assembly including a slidable portion slidably received in said guide track and having a rearward surface, said slidable portions being substantially sealed with the internal surface of said guide track to contain a substantially sealed volume of gas between said forward and rearward surfaces;

said power drive assembly being operable to move said slidable portion thereof in a plurality of reciprocating forward and reverse strokes within said guide track, said substantially sealed volume of gas maintaining a predetermined range of spaced distance between said forward and rearward surfaces of said slidable portions to establish a resilient, non-impacting driving relationship between said slidable portions during said forward and reverse strokes of the power drive assembly's slidable portion so that said substantially sealed volume of gas alternately moves said striker assembly through said drive stroke during the forward stroke of the power drive assembly's slidable portion and moves said striker assembly through said return stroke of the power drive assembly's slidable portion in order to drive said fastener into said workpiece, said substantially sealed volume of gas resiliently absorbing impacting of said driver member upon said fastener;

a feed mechanism constructed and arranged to feed successive fasteners into said drive track, each fastener being fed into said drive track after a preceding fastener has received said plurality of impacts and driven into said workpiece.

2. A fastening device according to claim 1, wherein a drive stroke length of said striker assembly is limited by said guide track.

3. A fastening device according to claim 1, wherein a drive stroke length of said striker assembly is limited by a range of movement of said power drive assembly.

4. A multi-stroke fastening device according to claim 1, wherein said power drive assembly is powered by a rechargeable battery.

5. A multi-stroke fastening device according to claim 1, further comprising a valve communicated to said substantially sealed volume of gas, said valve enabling replenishment of gas to said substantially sealed volume in the event a pressure thereof drops below a lower threshold level and enabling exhausting of gas from said substantially sealed volume in the event the pressure thereof exceeds an upper threshold level to thereby maintain the pressure within a predetermined range.

6. A multi-stroke fastening device according to claim 5, wherein said valve is a bleed valve.

7. A multi-stroke fastening device according to claim 1, further comprising means for enabling replenishment of gas to said substantially sealed volume in the event a pressure thereof drops below a lower threshold level and enabling exhausting of gas from said substantially sealed volume in the event the pressure thereof exceeds an upper threshold level to thereby maintain the pressure within a predetermined range.

8. A multi-stroke fastening device according to claim 1, wherein the slidable portion of said power drive assembly is a piston.

9. A multi-stroke fastening device according to claim 8, wherein the slidable portion of said striker assembly is a piston.

10. A multi-stroke fastening device according to claim 9, wherein the slidable portion of said striker assembly and the slidable portion of said power drive assembly each further include a seal element slidably engaging the internal surface of said guide track to substantially seal the slidable portions of said striker assembly and said power drive assembly with said internal surface to cooperatively define the substantially sealed volume of gas.

11. A multi-stroke fastening device according to claim 10, wherein said seal elements are formed from a resilient material.

12. A multi-stroke fastening device according to claim 11, further comprising a valve communicated to said substantially sealed volume of gas, said valve enabling replenishment of gas to said substantially sealed volume in the event a pressure thereof drops below a lower threshold level and enabling exhausting of gas from said substantially sealed volume in the event the pressure thereof exceeds an upper threshold level to thereby maintain the pressure within a predetermined range.

13. A multi-stroke fastening device according to claim 12, wherein said valve is a bleed valve.

14. A multi-stroke fastening device according to claim 11, further comprising means for enabling replenishment of gas to said substantially sealed volume in the event a pressure thereof drops below a lower threshold level and enabling exhausting of gas from said substantially sealed volume in the event the pressure thereof exceeds an upper threshold level to thereby maintain the pressure within a predetermined range.

15. A multi-stroke fastening device according to claim 1, wherein the slidable portion of said striker assembly is a piston.

16. A multi-stroke fastening device according to claim 1, wherein the slidable portion of said striker assembly further includes a seal element slidably engaging the internal surface of said guide track to substantially seal the slidable portion of said striker assembly with said internal surface.

17. A multi-stroke fastening device according to claim 16, wherein said seal element is formed from a resilient material.

18. A multi-stroke fastening device according to claim 1, wherein the slidable portion of said power drive assembly further includes a seal element slidably engaging the internal surface of said guide track to substantially seal the slidable portion of said power drive assembly with said internal surface.

19. A multi-stroke fastening device according to claim 18, wherein said seal element is formed from a resilient material.

* * * * *

UNITED STATES PATENT AND TRADEMARK OFFICE

CERTIFICATE OF CORRECTION

PATENT NO. : 6,488,195 B2
DATED : December 3, 2002
INVENTOR(S) : White et al.

It is certified that error appears in the above-identified patent and that said Letters Patent is hereby corrected as shown below:

Title page,
Item [75], Inventors, please delete "Charles W. Hewitt".

Signed and Sealed this

Sixth Day of May, 2003

JAMES E. ROGAN
*Director of the United States Patent and Trademark Office*